US012006816B2

(12) United States Patent
Al-Dhafeeri et al.

(10) Patent No.: US 12,006,816 B2
(45) Date of Patent: Jun. 11, 2024

(54) WELL INTEGRITY MANAGEMENT FOR NATURAL FLOW OIL WELLS

(71) Applicant: Saudi Arabian Oil Company, Dhahran (SA)

(72) Inventors: Abdullah M. Al-Dhafeeri, Al Khobar (SA); Shebl Fouad Abo Zkry, Al Khafji (SA)

(73) Assignee: Saudi Arabian Oil Company, Dhahran (SA)

( * ) Notice: Subject to any disclaimer, the term of this patent is extended or adjusted under 35 U.S.C. 154(b) by 77 days.

(21) Appl. No.: 17/648,050

(22) Filed: Jan. 14, 2022

(65) Prior Publication Data

US 2023/0228186 A1 Jul. 20, 2023

(51) Int. Cl.

| | |
|---|---|
| ***E21B 33/03*** | (2006.01) |
| ***E21B 34/02*** | (2006.01) |
| ***E21B 47/06*** | (2012.01) |
| ***E21B 47/117*** | (2012.01) |
| ***E21B 49/08*** | (2006.01) |

(52) U.S. Cl.

CPC ..... *E21B 47/117* (2020.05); *E21B 33/03* (2013.01); *E21B 34/02* (2013.01); *E21B 47/06* (2013.01); *E21B 49/087* (2013.01); *E21B 2200/20* (2020.05); *E21B 2200/22* (2020.05)

(58) Field of Classification Search

CPC ..... E21B 33/03; E21B 34/02; E21B 47/06; E21B 47/117; E21B 49/087

See application file for complete search history.

(56) References Cited

U.S. PATENT DOCUMENTS

| | | | | |
|---|---|---|---|---|
| 9,494,710 | B2 * | 11/2016 | Gonzales | G01V 99/005 |
| 9,528,364 | B2 * | 12/2016 | Samuel | E21B 47/006 |
| 10,310,127 | B2 * | 6/2019 | Hoversten | G01V 1/52 |
| 2016/0003027 | A1 * | 1/2016 | Thompson | E21B 33/04 73/152.57 |
| 2017/0363088 | A1 * | 12/2017 | Nguyen | E21B 47/008 |
| 2018/0179881 | A1 * | 6/2018 | Thompson | E21B 33/0422 |
| 2019/0302291 | A1 * | 10/2019 | Lolla | G01V 1/288 |

OTHER PUBLICATIONS

U.S. Appl. No. 17/648,047, Al-Dhafeeri et al., filed Jan. 14, 2022.

Al-Dhafeeri et al. "Lessons Learned from Tubing Leaks in ESP Completion at Offshore Field," IPTC-20032, presented at the International Petroleum Technology Conference, Jan. 2020, 20 pages.

Li et al., "Condition Monitoring and Fault Diagnosis of Electric Submersible Pump Based on Wellhead Electrical Parameters and Production Parameters," System Science & Control Engineering, 2018, 6(3):253-261, 10 pages.

* cited by examiner

*Primary Examiner* — Matthew R Buck

(74) *Attorney, Agent, or Firm* — Fish & Richardson P.C.

(57) ABSTRACT

Systems and methods include a computer-implemented method for determining an integrated surface-downhole integrity score for a natural flow oil well. Wellness surface parameters of a natural flow oil well are determined. Wellness downhole parameters for the natural flow oil well are determined, including parameters indicating well integrity and tubing/casing conditions. An integrated surface-downhole integrity score is determined using the wellness surface parameters and the wellness downhole parameters. An alert is provided for presentation to an operator in a user interface. The alert is provided in response to the integrated surface-downhole integrity score exceeding a threshold.

17 Claims, 16 Drawing Sheets

WELL INTEGRITY MANAGEMENT FOR NATURAL FLOW OIL WELLS

TECHNICAL FIELD

The present disclosure applies to improving integrity management in natural flow oil wells.

BACKGROUND

An effectiveness well integrity management (WIM) program is an essential tool to be implemented over a well's life cycle. The WIM program can include a method selection with consideration of available tools in order to maintain the operability of oil wells at a healthy and a safe manner. An effectiveness WIM program can help to prevent issues related to well safety and integrity, which can improve the operation practices in terms associated with production losses and reducing well downtime. Regarding processes related to casing leak detection, extensive work has been conducted by offshore field activities, including surveillance programs and well integrity campaigns. The work has provided informative data interpretation for use in designing proper remedial action for offshore oil wells having integrity and safety issues. The findings from well intervention (surface and downhole) can be integrated to better identify and understand problems related to wellbore leaks and cross flow behind pipes.

SUMMARY

The present disclosure describes techniques that can be used for determining an integrated surface-downhole integrity score for Christmas tree and wellhead assembly valves of a natural flow oil well. In some implementations, a computer-implemented method includes the following. Wellness surface parameters of a natural flow oil well are determined. Wellness downhole parameters for the natural flow oil well are determined, including parameters indicating well integrity and tubing/casing conditions. An integrated surface-downhole integrity score is determined using the wellness surface parameters and the wellness downhole parameters. An alert is provided for presentation to an operator in a user interface. The alert is provided in response to the integrated surface-downhole integrity score exceeding a threshold.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Natural flow wells can have improved production operation, including the following. A simple approach can be used to identify tubing/casing leaks in natural flow wells. The well integrity and safety of natural flow wells can be maintained. Natural flow well productivity can be maintained. Natural flow well operation life can be maximized. Tubing leak problems can be identified. The uncertainty related to well integrity conditions can be resolved. Cost-effective approaches can be made in downhole intervention. Oil spill and environment impacts can be prevented. Risks related to well blowout and assets damage can be avoided. Underground fluid invasion into water aquifers can be prevented. Downhole cross flow between multi-oil bearing reservoirs can be avoided. Formation damage due to dumping water into oil bearing reservoirs can be avoided. Hydrocarbon leaks that may jeopardize a production platform can be prevented.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

Figure 1:
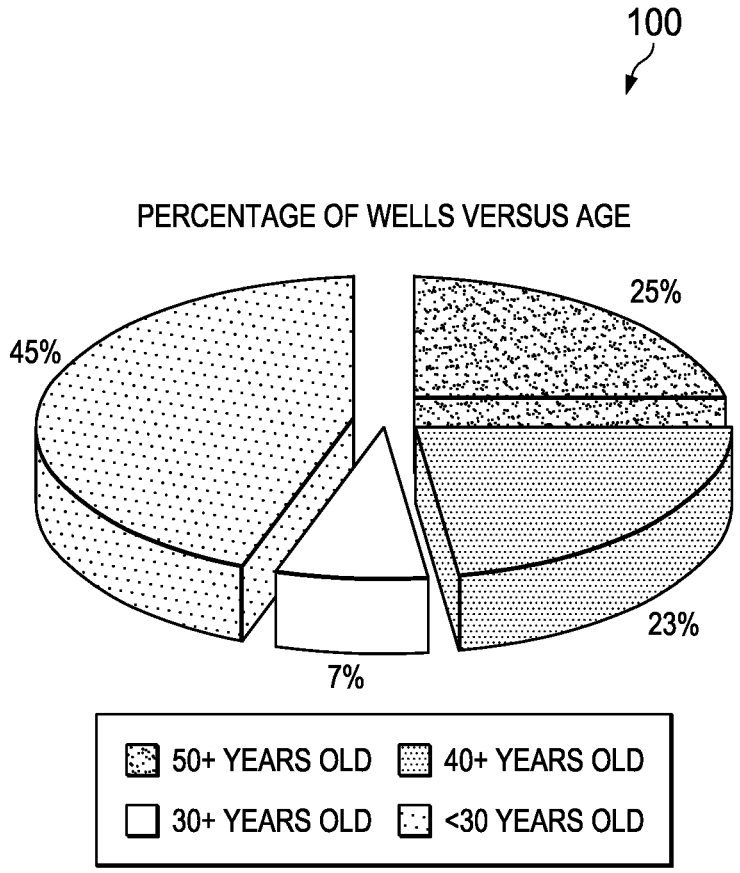
FIG. 1 is a pie chart diagram showing an example percentage distribution summary of wells versus well age, according to some implementations of the present disclosure.

The following detailed description describes techniques for determining an integrated surface-downhole integrity score for Christmas tree and wellhead assembly valves of a natural flow well. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

The present disclosure describes new techniques for improving well integrity management related to sustained casing pressure (SCP), tubing/casing leaks, well safety systems, and wellhead/Christmas trees. The new techniques are related to identifying tubing/casing leaks in natural flow wells in oil fields utilizing wellhead inspection and maintenance campaigns to perform remedial action plans.

Well Integrity Management

A well integrity management (WIM) program can be started by creating a baseline in terms of a temperature profile for each well using a cost-effective time-lapse. The baseline can serve as a reference for a geothermal gradient log recorded in a shut-in condition. Slickline operations can be performed to execute bottomhole temperature surveys. Such surveys and temperature profile interpretation can add great value in terms of confirming wellbore integrity and detecting anomalies such as sustained casing pressure and casing leaks. Effectiveness WIM programs, including methodologies of monitoring, detecting, and localizing leak phenomena across shallow aquifers, can be used to extend well operability life.

As part of well integrity and safety campaigns in offshore fields, downhole temperature surveys can be obtained as a record of temperature values measured with respect to depth steps (logs) in a well. Downhole conditions, including temperature measurements at various depths for each well, can be used to determine well status and to prevent serious reservoir damage, for example, if there is a cross-flow phenomenon. Oil wells can be evaluated through the well integrity and safety campaigns in terms of downhole integrity, especially regarding casing leaks and associated problems. Due to long periods of shutdown for the field, close monitoring surveys with more focus on aged wells can be used to avoid flow behind pipe and cross flow phenomena, which can lead to formation damage and production losses.

Several field cases were conducted to illustrate casing leaks in offshore oil wells. A capture of temperature anomalies was identified with a clear deviation from a baseline gradient. Based on the evaluation results, many anomalies were identified that were related to the entry of fluids into the borehole. However, some cases indicated that the fluid flow was upward. It is noted that the temperature was affected by the type of occupied fluid on the outside casing and by the type of movements. As a result, the temperature profile was sensitive not only to the borehole condition but also to the formation type and the casing-formation annulus.

Wells completions were evaluated and their temperature profiles were interpreted to capture temperature anomalies leading to casing leaks, flow behind pipe, and a cross flow phenomenon. The anomalies required further investigation by integrating techniques with other integrity surveillance logs. In addition, the results from workover operations were analyzed with the remedial actions in order to validate the findings.

Tubing/casing leaks are generally related to significant corrosion in a well, such as resulting from poor cement placement across shallow formations containing a corrosive fluid. Tubing/casing leak repair options can be expensive and can vary based on well type, tubing/casing size and condition, interval depth, and leak path. The options available for a repair though a well workover operation can include a cement-squeezing job, a casing liner/patch, and a chemical treatment job. In the case of a well with a failure to fix tubing/casing leaks, the subject well can be a candidate for a suspension or an abandonment. Tubing/casing leaks can lead to loss of well integrity, and consequently well productivity. Moreover, the issue can develop serious risks to people, safety, and the environment. Leak detection diagnoses in terms of fluid type, source/location, and rate/size, can affect the selections of corrective remedial action prior to the well workover operation. Therefore, problem identification with proper tools is an essential to have better understanding on which methodology to be utilized at a cost effective manner.

Tubing/casing leak locations can be expected across any of the well barriers that exhibit, for example, poor cementing behind casing, tubing/casing pipe joints and connections, and packers and completion components. Generally, large numbers of casing leaks can occur in the casing annulus between the production tubing and production casing (TCA). However, it is common to have tubing/casing leaks in the annulus between casing-casing (CCA), which can have a serious impact on well operation safety and integrity. Issues related to casing leaks can be challenging to analyze with conventional methods of well integrity assessment services such as corrosion and cement evaluation logging, bottom hole pressure temperature surveys, and annuli pressure surveys. Tubing/casing leak detection linked with locations through well barrier leaks can add great value in terms of a well integrity management system and well safety to be monitored and evaluated on a frequent basis, with support from other tools such as wireline activities, wellhead parameters, and collected fluid samples. Some cases of casing leaks with hydrocarbon returns can lead to a costly rig intervention for workover operation, which can result in well suspension or abandonment. Tubing/casing leak issues can also adversely affect the environment (if not controlled with an immediate action plan) or lead to production shutdowns in offshore environments. Developing well integrity by fixing tubing/casing leaks through detecting a leak's location is highly important with an assessment of root causes, including the flow path with the source, location, and size of the features, which are necessary to prepare a corrective action program.

Temperature profiles along well borehole depths can be used in well integrity assessment. Additional value can be realized by utilizing temperature measurements in order to correct well logging (e.g., resistivity), which is sensitive to temperature profiles. Bottom hole pressure temperature (BHPT) surveys with downhole parameter measurements can be utilized to evaluate well productivity and water movement. Temperatures that increase with depth can be linked to a geothermal gradient in terms of the rate of temperature change with respect to the borehole depth. In some cases, homogenous formations with temperature gradients can be used to vary depths based on a geographical location and the thermal conductivity of the formation. Temperature profiles integrated with other surface parameters can provide a primary diagnostic tool for identifying potential casing leak locations. Plots of temperature profiles using a time-lapse techniques with an interpretation of temperature gradient changes can be utilized to determine fluid movement and/or fluid entry location. These techniques can be improved with management of well integrity.

Well Integrity

Well integrity for natural flow wells can utilize data integration between surface and downhole parameters for offshore/onshore natural flow oil wells during well operational phases and shutdown conditions. The present disclosure relates to techniques for effectively identifying tubing/casing leaks in natural flow oil wells. Such wells typically suffer from integrity and safety issues and can benefit from recommendations of proper mitigation plans with remedial action programs. The loss of integrity in a natural flow oil well can ultimately lead to natural flow system failures as well as an uncontrolled release of fluids, which can lead to production loss and unacceptable safety and environmental consequences.

Techniques of the present disclosure can solve challenges related to monitoring programs and improving operation efficiency in order to maximize the well production potential, reduce production interruptions, and minimize operational costs. Based on information from monitoring programs and maintenance inspections on wells, it has been determined that the majority of natural flow well failures occur due to tubing/casing leaks and valves. Therefore, high rates of workover jobs and mitigation actions for natural flow wells are associated with tubing/casing leaks.

Techniques for identifying the tubing/casing leaks in natural flow wells can utilize data integration between surface and downhole parameters. The techniques can be part of well integrity management in terms of monitoring programs and maintenance inspection on wells. Such techniques can lead to benefits related to maximizing well production potential and reducing operation costs, which can improve well operation efficiency in order to sustain maximum production targets.

Completion string leakage in natural flow wells can be caused by many reasons during the production phase of an oil well. Leakage can occur, for example, because of conditions associated with corrosive fluids, sand production, and material failure. Offshore oil wells can suffer failures due to tubing/casing leaks. The failures can lead to a costly rig operation and production loss. A major challenge of completion string leaks is related to problem identification in terms of symptoms which depend on many factors, such as leak location and a degree of leakage.

FIG. 1 is a pie chart diagram showing an example percentage distribution summary 100 of wells versus well age, according to some implementations of the present disclosure. The summary summarizes the percentage of wells versus age in order to understand well integrity issues related to the age of wells. The wells identified in the summary 100 were completed with conventional drilling practices. Casings design criteria for the wells were based on two overlapping strings of 18⅝ and 13⅜ inch sizes of carbon steel alloy across the aquifer and cemented barriers. Using cement evaluation for cement distribution quality between aquifer and downward to top of some reservoirs, it was revealed that a poor cement bond leads to a loss of zonal isolation and a well barrier failure. These findings also indicated that water is allowed to be channeled behind the casing from a shallow aquifer into the reservoir. This can lead to the potential for formation damage occurring due to water invasion into the reservoir and resulting relative permeability effects. In addition, serious corrosion effects on 9⅝ inch casing across shallow aquifer can be confirmed and observed on other wells, resulting in a severe corrosion rate on 7-inch casing (production casing) with a casing leak. Table 1 lists examples of the number of wells with casing leaks relative to well age.

TABLE 1

Summary of Number of Oil Wells With Tubing/Casing Leaks by Age

| Number of Wells Versus Age | Number of Wells With Casing Leaks |
|---|---|
| 79 wells are 50+ years old | 3 |
| 70 wells are 40+ years old | 5 |
| 22 wells are 30+ years old | 1 |
| 139 wells are less than 30 years old | 3 |
| Total: 310 wells | 12 |

Figure 2A:
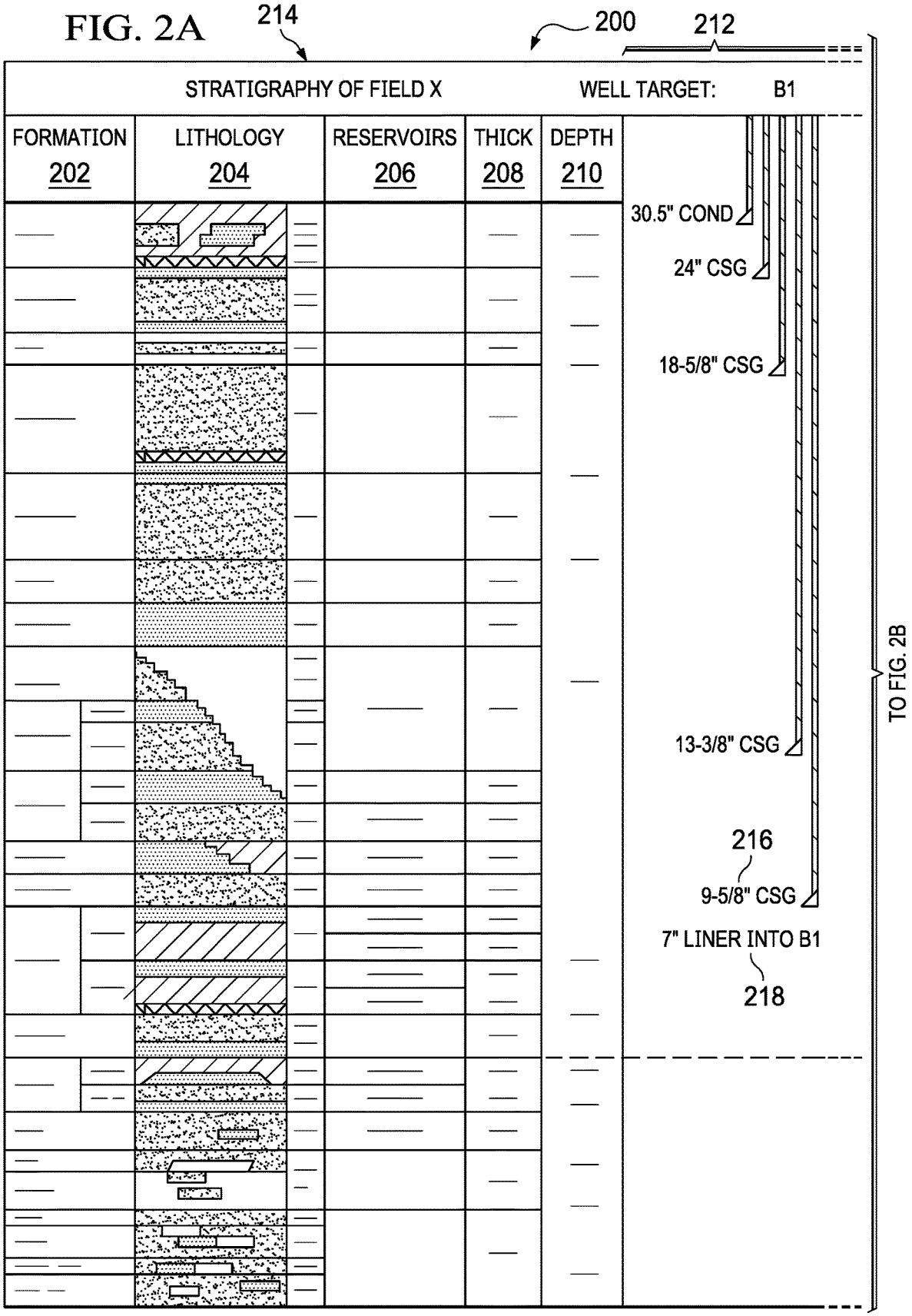
FIGS. 2A-2B are diagrams collectively showing an example of a cross section in casing design for an offshore well, according to some implementations of the present disclosure.
Figure 2B:
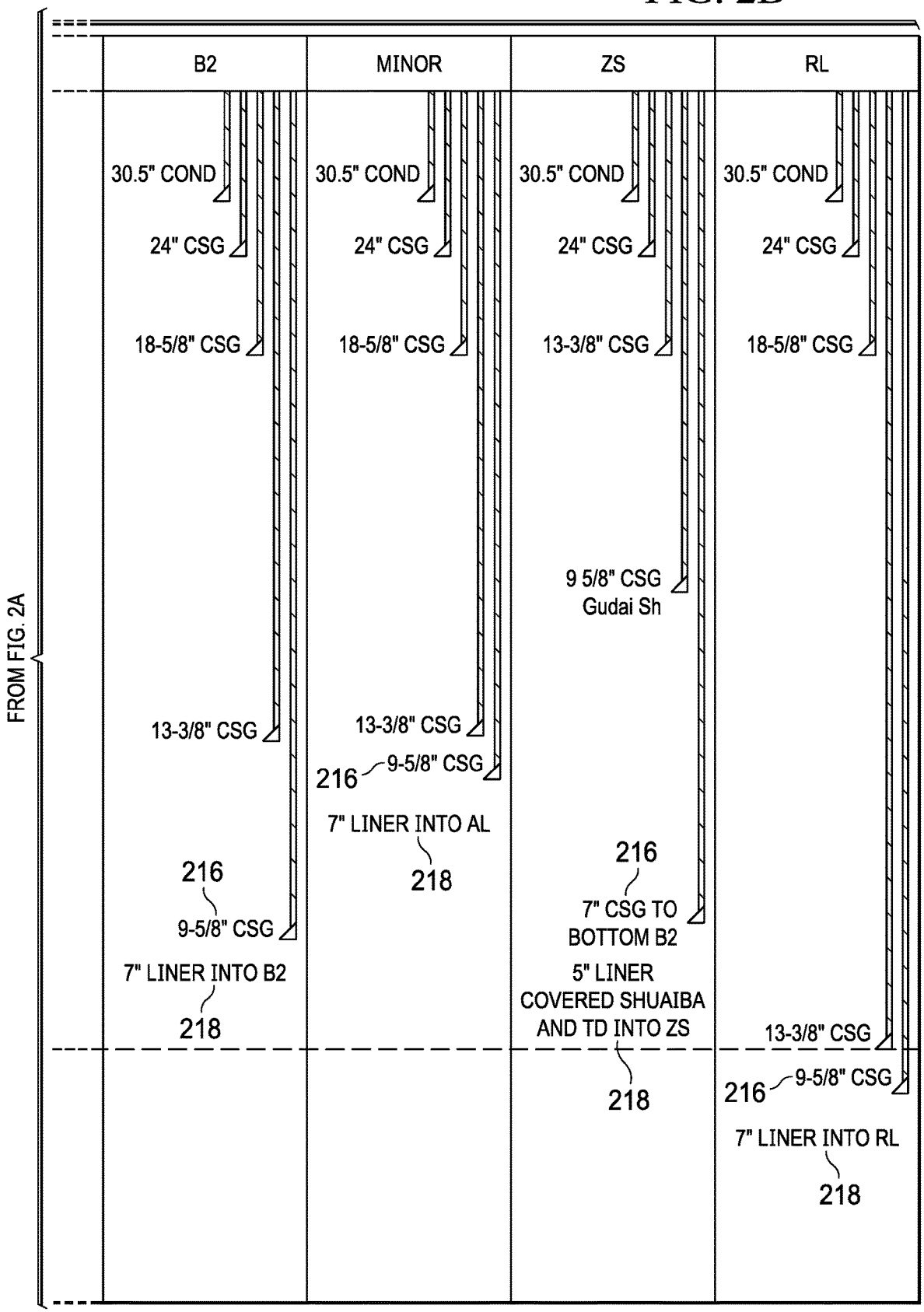

FIGS. 2A-2B are diagrams collectively showing an example of a cross section 200 in casing design for an offshore well, according to some implementations of the present disclosure. The cross section 200 includes a stratigraphy table 202 that identifies formation and sub-formation names 204, lithology graphics and descriptions 206, reservoirs encountered 208, thicknesses 210, and depths 212. Well target statistics 214 identify specific targets 216. For each of the specific targets 216, tubing diameters and types 216 are displayed. Liner diameters 218 and target names are also identified.

In conventional practices for confirming a well to be cemented to the required depth, the location of the cement top behind the casing can be determined using a rule based on the heat of cured cement with respect to the time. Therefore, a temperature logging is utilized to confirm a cemented well to the required depth. This behavior can be determined when a geothermal gradient baseline is created compared to the true vertical depth (TVD). The temperature log should be run while the cement is undergoing a setting process, during which it is expected that the temperature decreases with time. An attempt was made to apply the technique for casing leak detection while the temperature profiles continuously monitored geothermal gradient deviation from the geothermal baseline. An increase above the geothermal indicates a leak upward behind the casing, while a decrease below the geothermal indicates a leak downward as shown in FIG. 3.

Figure 3:
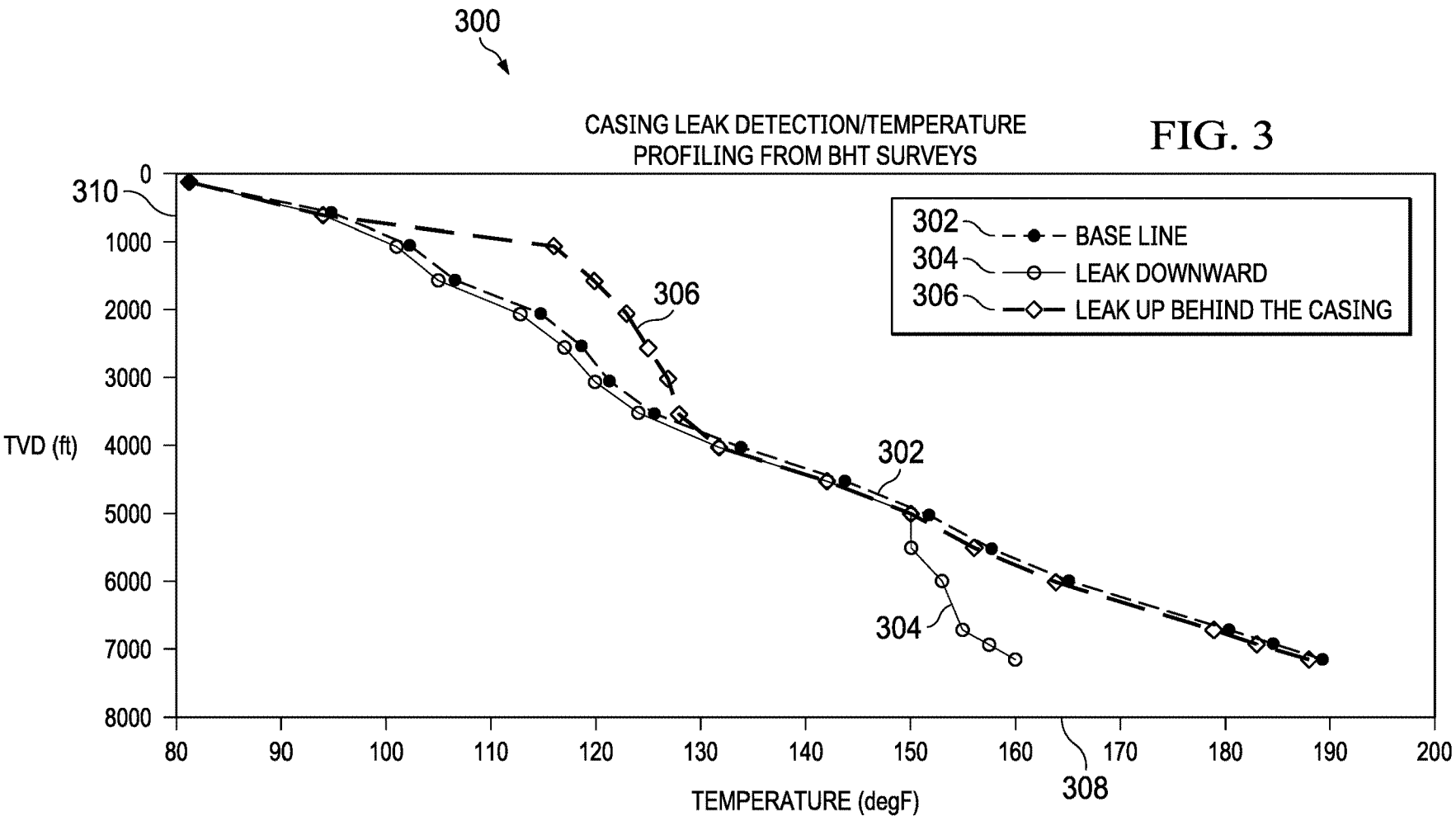
FIG. 3 is a graph showing an example of temperature gradient and tubing/casing leak detection, according to some implementations of the present disclosure.

FIG. 3 is a graph 300 showing an example of temperature gradient and tubing/casing leak detection, according to some implementations of the present disclosure. The graph 300 includes a baseline 302, a leak down line 304, and a leak up line 306. The lines are plotted relative to a temperature 308 (e.g., in degrees Fahrenheit (° F.)) and a TVD 310.

As a result of applied time-lapse techniques for a temperature gradient of bottom hole pressure temperature (BHPT) surveys to identify temperature anomalies, it was observed that wells can suffer from a casing leak and a cross flow phenomenon due to a shallow aquifer (formation with corrosive water bearing). Therefore, such wells can be recommended as candidates for a workover operation to fix and restore well integrity accordingly.

Tubing/Casing Leak Detection Tools

Integration of the findings related to a well integrity management (WIM) data acquisition program, including surface/downhole parameters, is highly recommended to define the wells with safety and integrity issues such as sustained casing pressure (SCP), casing leaks, and well completion accessories failures. There are several tools and techniques that can be used in surface and/or downhole situations to assist in identifying a casing's condition. These tools can vary in methodologies and may be costly depending on the well type and severity of the leak. The different techniques for casing leak detection can be summarized as follows.

Well Performance Review

Well performance review is a tool that can be used to evaluate well integrity and operability condition. The review can be done through a frequent measuring with a close monitoring of the well's on-surface parameters, such as wellhead flowing pressures and temperatures, water cut, and production testing data. In addition, artificial lift wells performance monitoring can be implemented by controlling the volume of gas injection rate and the casing head pressure for natural flow (GL) wells. Abnormal features and/or dramatic changes for surface parameter trends can be used and combined with other tools to identify well problems such as unexpected increase of water cut trend, which is related to either reservoir or well integrity issues.

Annuli Pressure Surveys Monitoring

As part of WIM, casings annulus pressures can be monitored frequently, such as semi-annually, through annuli pressure survey. A plot showing a pressure trend versus time can be beneficial if the plot is combined with other tools to detect the presence of the annulus pressure at a wellhead surface. In particular, a sustained annulus pressure (SAP) is considered the most common and critical type of annulus pressure, which can be an indication of a failure of one or more barrier elements. SAP can also provide a communication between a pressure source within the well and an annulus (as per ISO/TS 16530-2-2013). Normally, in order to detect a tubing/casing leak, the annulus may have a positive pressure with continuous fluid flow return when it is bled off as part of wellhead integrity monitoring.

Communication and Bleed-Down/Build-up Tests

Pressure bleed-down/build-up and communication tests can be applied if the recorded casing annulus pressure is positive, which can be attributed to a sustained casing pressure issue. The main objective of this test is to confirm the presence of build-up pressure at the wellhead sections by bleeding the wellhead down to zero to ensure the sustainability of casing pressure in terms of returned fluid rate and pressure build-up values. Bleed-down tests can be performed safely through a ½-inch needle valve. A collected sample from a fluid return can be analyzed in order to identify the source of leaks in terms of interval depth and fluid properties. Communication tests can be conducted between production tubing and production casing to confirm the change with pressure behaviors, which may be connected with other casings at a wellhead. An example of bleed-down, build-up pressure test is illustrated for offshore in FIG. 4.

Figure 4:
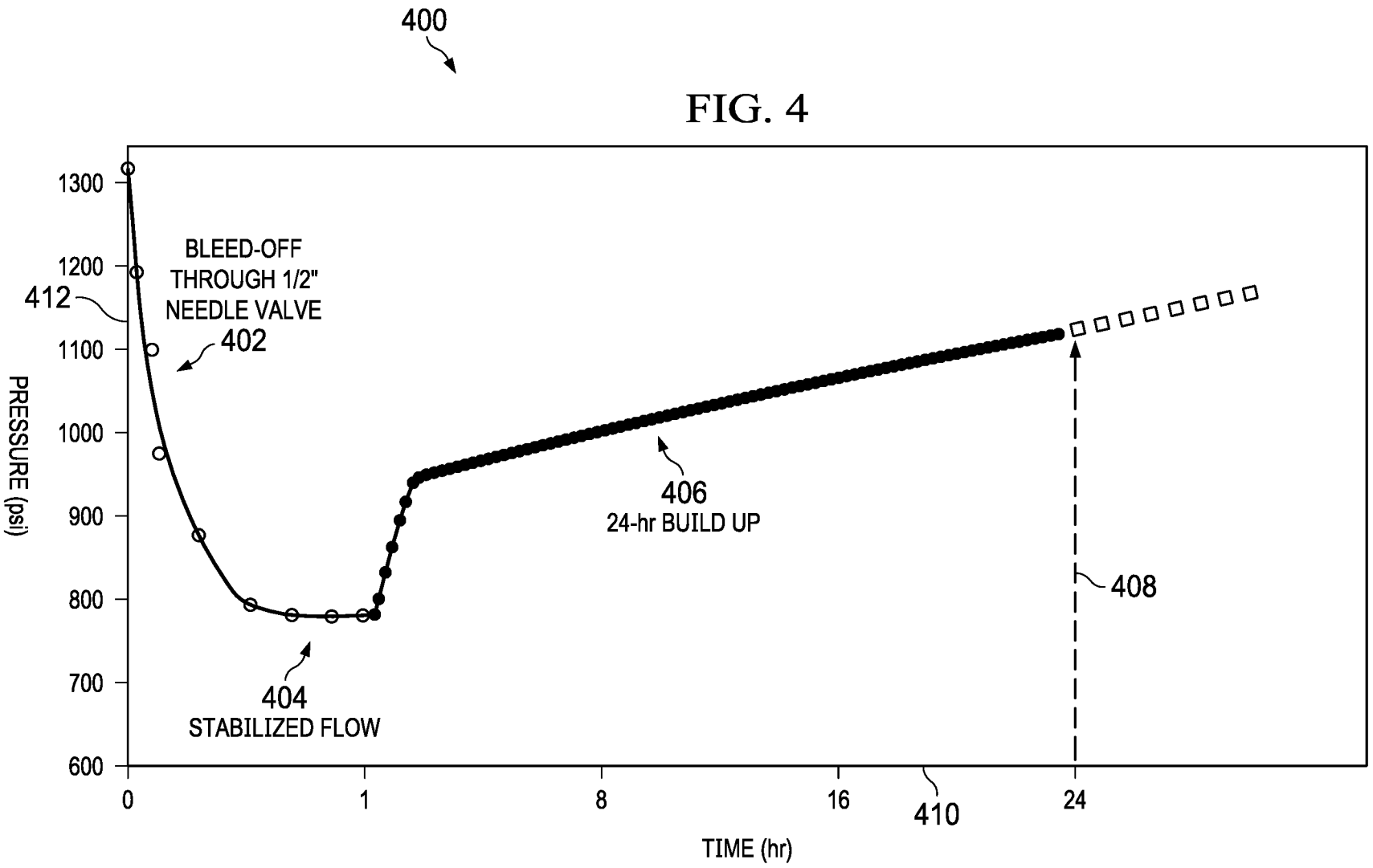
FIG. 4 is a diagram showing an example of a trend for a bleed-down/build-up test for offshore well, according to some implementations of the present disclosure.

FIG. 4 is a diagram showing an example of a trend 400 for a bleed-down/build-up test 400 for offshore well, according to some implementations of the present disclosure. The trend 400 includes a bleed-off 402 through a ½-inch needle valve, a stabilized flow 404, and a 24-hour build-up 406 leading to a 24-hour time 408. The trend 400 is plotted relative to a time axis 410 (e.g., in hours) and a pressure axis 412 (e.g., in pounds per square inch (psi)).

Fluid Sample Analysis

Laboratory analysis results of collected fluid samples can help to understand and to distinguish between reservoir formation water and shallow aquifer water in terms of water salinity. In order to detect the source of leaks either from deeper formations or from shallow aquifers, each formation's fluid properties can be used to identify the source in terms of location and interval depth. Therefore, geochemical water analysis of the produced water can be used for identifying the occurrence of a casing leak when the chemistry of the water produced is known. Based on a water salinity mapping of each reservoir, a fingerprint of detected leaks can be used as evidence to prove the source of leaks. However, this technique is still challenging in some cases due to the mixing between the produced formation water and shallow formation water. On other hand, the integration of water analysis and communication and bleed-down, build-up test findings with changes in well performance parameters can be useful to confirm a casing leak. Moreover, the physical and chemical properties related to produced water may differ based on well location, type of hydrocarbon produced, and temperature/pressure.

Downhole Techniques Utilized for Detecting Casing Leak

Slickline bottom-hole pressure/temperature (BHPT) surveys and wireline logging are reliable tools for detecting casing leaks. A flowchart identifying techniques for casing leaks detection is shown in FIG. 5.

Figure 5:
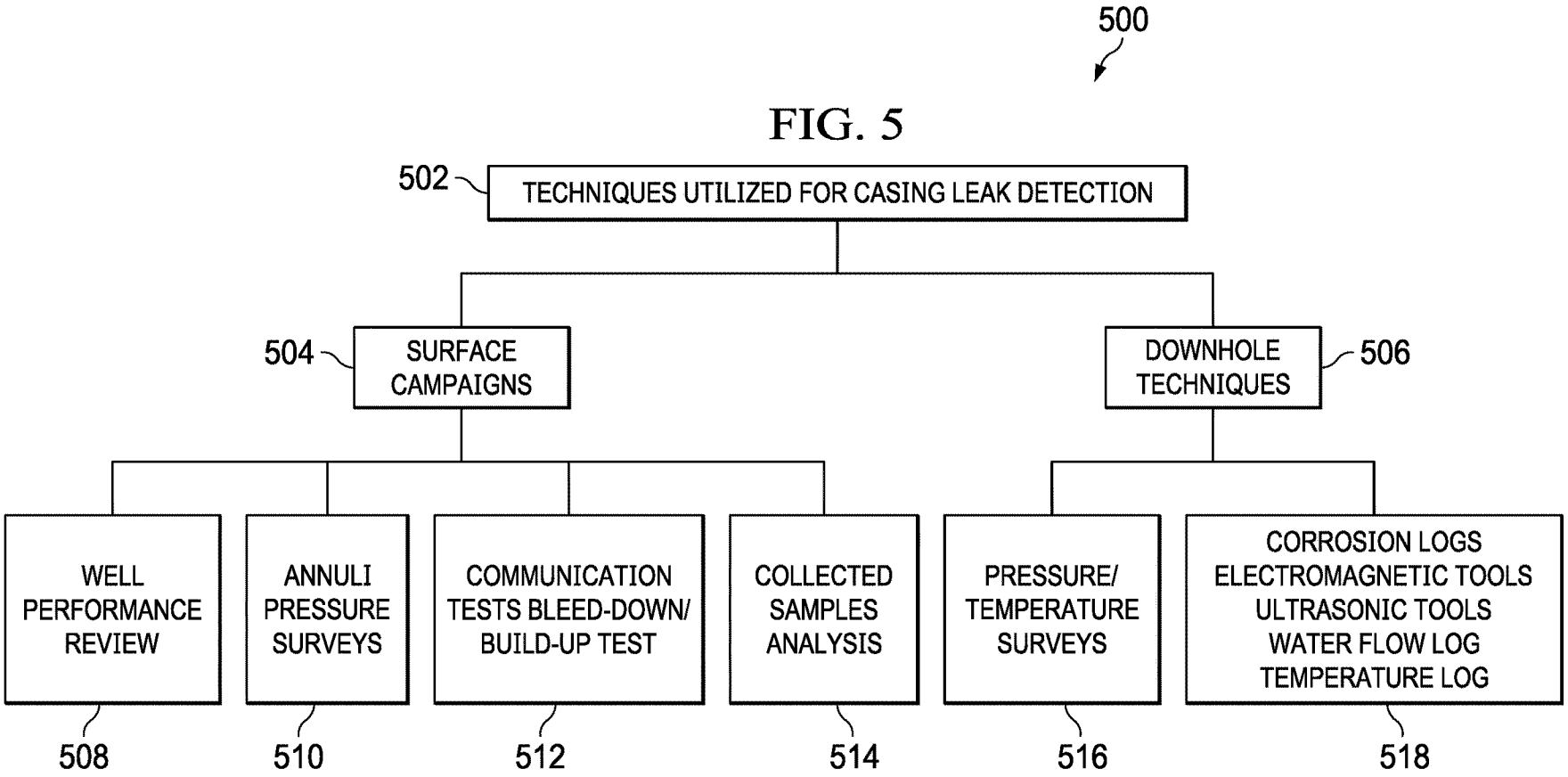
FIG. 5 is a diagram showing an example of a summary of different techniques utilized for casing leak detection, according to some implementations of the present disclosure.

FIG. 5 is a diagram 500 showing an example of a summary of different techniques 502 utilized for casing leak detection, according to some implementations of the present disclosure. The different techniques 502 include surface techniques 504 and downhole techniques 506. The surface techniques 504 include, for example, well performance reviews 508, annuli pressure surveys 510, communication tests 512 (including bleed-down, bleed-up tests), and collected samples analysis 514. The downhole techniques 506 include, for example, pressure/temperature surveys 516, and downhill tools and logs, including corrosion logs, electromagnetic tools, ultrasonic tools, water flow logs, and temperature logs.

Figure 6A:
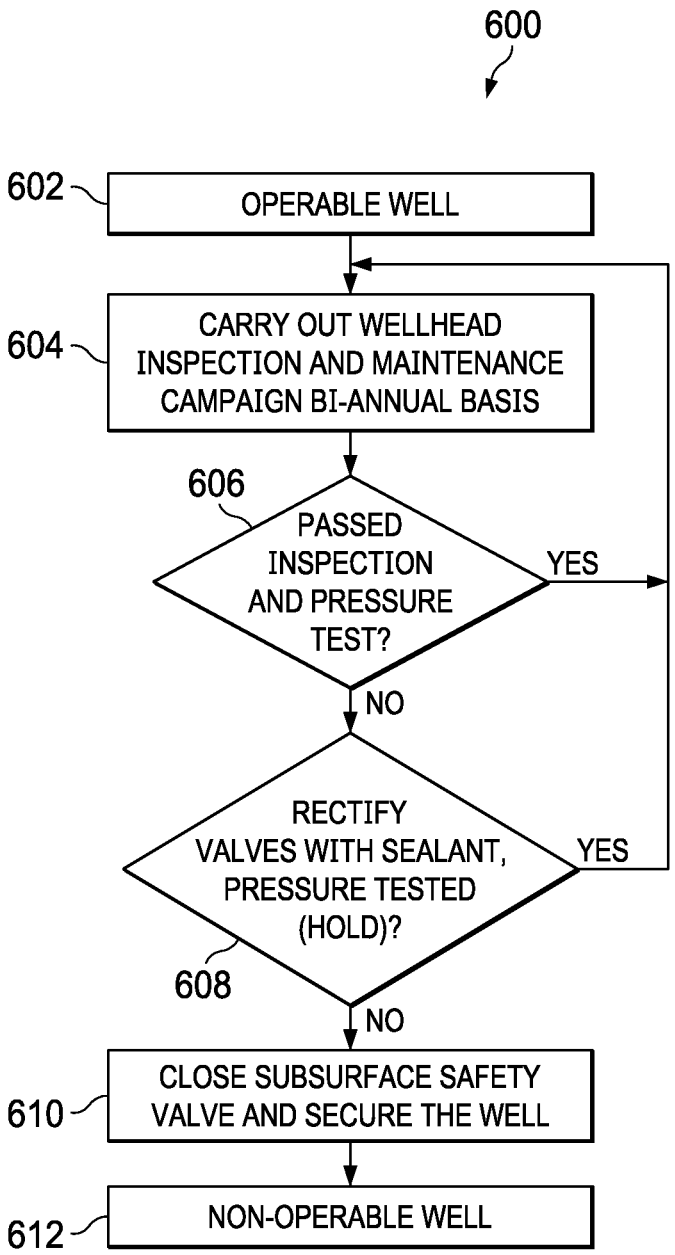
FIG. 6A is a flowchart showing an example of a workflow including general procedure steps of natural flow oil well integrity management related to a Christmas tree and wellhead assembly, according to some implementations of the present disclosure.

FIG. 6A is a flowchart showing an example of a workflow 600 including general procedure steps of natural flow oil well integrity management related to a Christmas tree and wellhead assembly, according to some implementations of the present disclosure. The workflow 600 starts at 602 with an operable well. At 604, wellhead inspection and maintenance campaigns are performed regularly (e.g., on a bi-annual basis) to monitor Christmas tree and wellhead assembly valves for a subject well.

At 606, if the Christmas tree and wellhead assembly valves pass pressure/function tests, then the well is still considered to be an operable well, and monitoring continues at 606. Otherwise, if the Christmas tree and wellhead assembly valves do not pass pressure/function tests, then at 608, actions are taken to rectify valves with sealant injection, and the pressure test is repeated. At 608, if the valves' integrity improves and the valves hold pressure, then the well is considered as operable, and monitoring continues at 604.

Figure 6B:
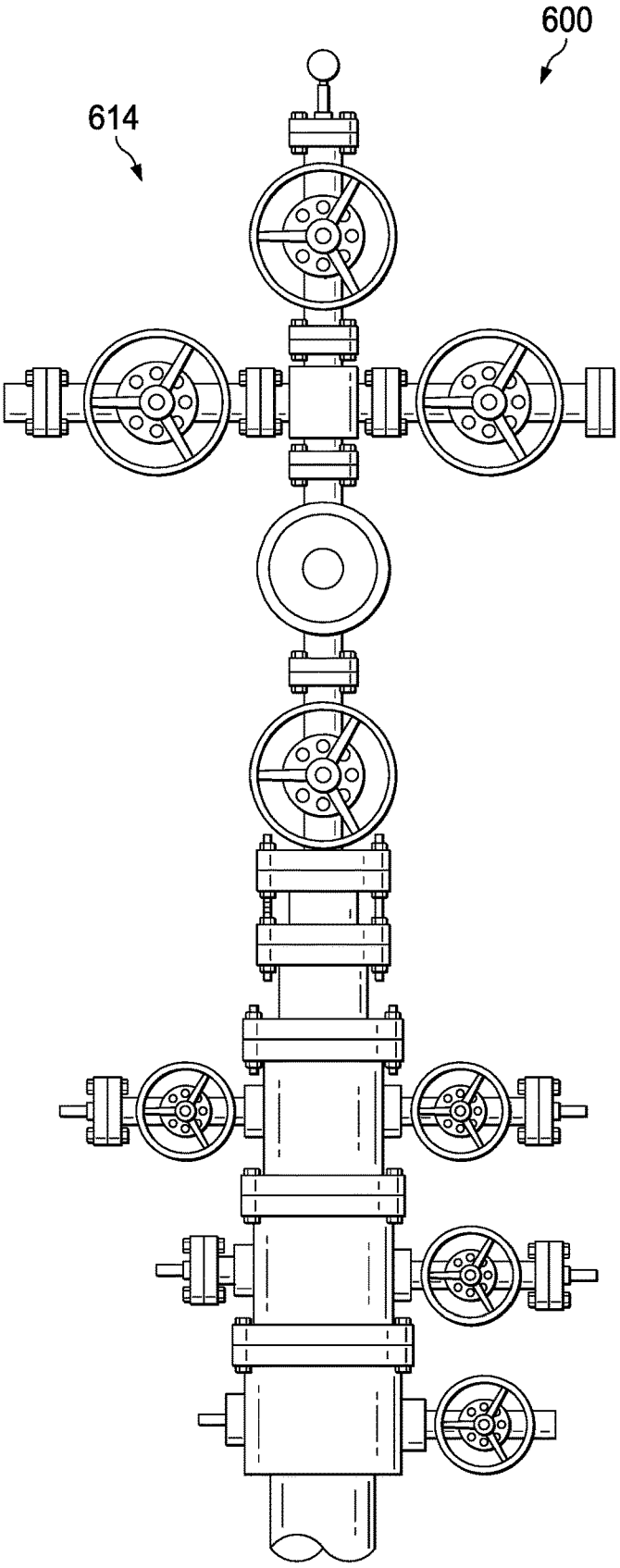
FIG. 6B is a diagram of an example of a well, according to some implementations of the present disclosure.

If the valves' integrity does not improve (meaning that the pressure test does not hold), then, at 610, the subsurface safety valve is closed and the wellhead is secured. At 612, the well is classified as a non-operable well, and the well becomes a candidate for a repairing action to change out defective wellhead and Christmas tree valves. Sketch 614 shows an example of a Christmas tree and wellhead assembly for a natural flow well that corresponds to the steps of workflow 600. FIG. 6B is a diagram of an example of a well 614, according to some implementations of the present disclosure.

Figure 7A:
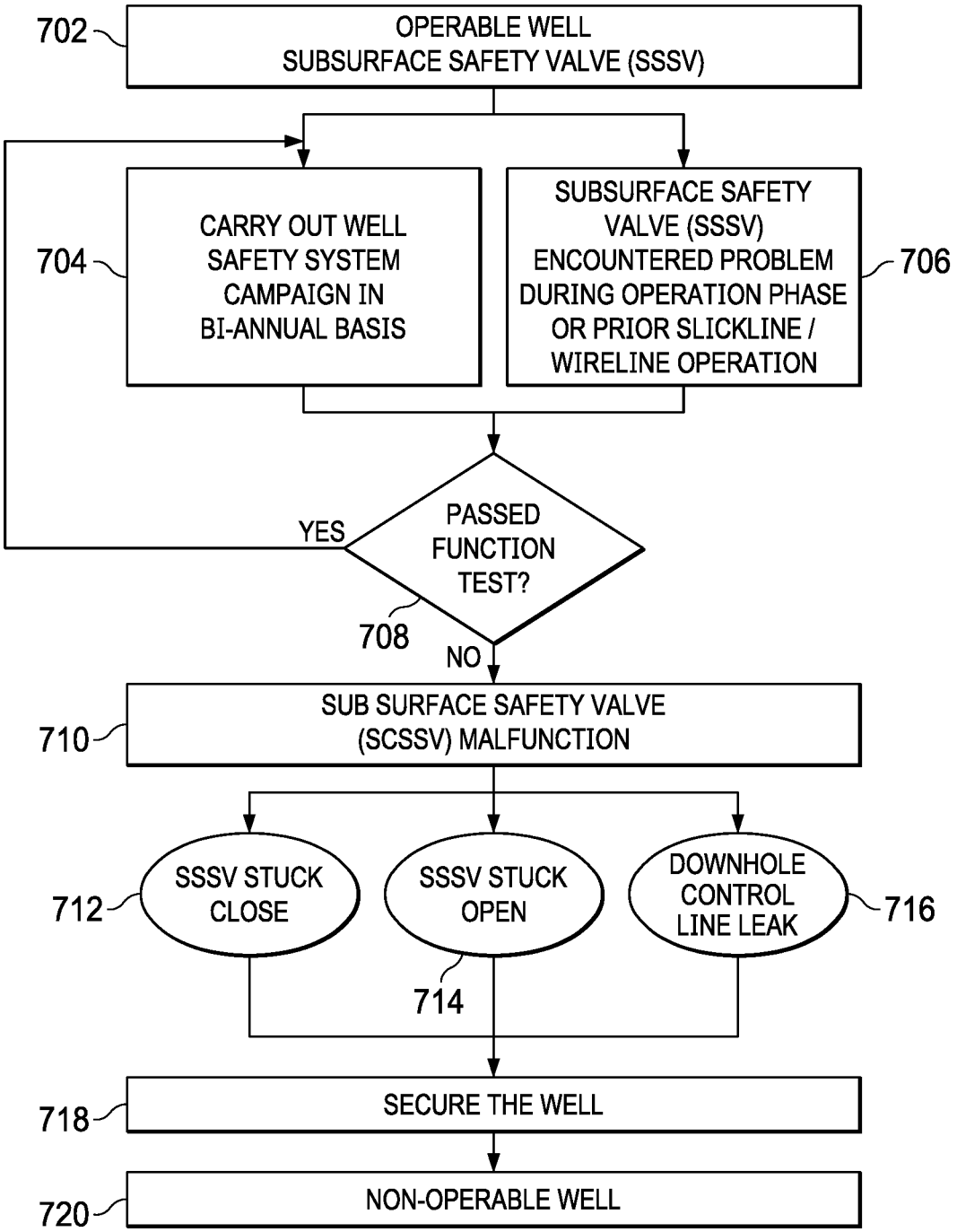
FIG. 7A is a flowchart showing an example of a workflow including general procedure steps a natural oil well integrity management related to a subsurface safety valve (SSSV), according to some implementations of the present disclosure.

FIG. 7A is a flowchart showing an example of a workflow 700 including general procedure steps of ESP oil well integrity management related to a subsurface safety valve (SSSV), according to some implementations of the present disclosure. The workflow 700 starts at 702 with an operable well with an SSSV. At 704, well safety system inspections and maintenance campaigns are carried out (for example, on a bi-annual basis) on surface-controlled subsurface safety (SCSSV) valves for a subject well. At 706, it may be determined that the SSSV encountered problems during the operational phase or prior to slickline/wireline operations. At 708, if the subsurface safety valve passes pressure/function tests, then the well is considered to be an operable well, and monitoring continues at step 704.

At 710, if a malfunction in the SCSSV is detected (e.g., if the subsurface safety valve fails pressure/function tests), then three conditions are possible, as follows. At 712, the subsurface safety valve is stuck in a closed position. At 714, the subsurface safety valve is stuck in an open position. At 716, a downhole control line leak exists.

Figure 7B:
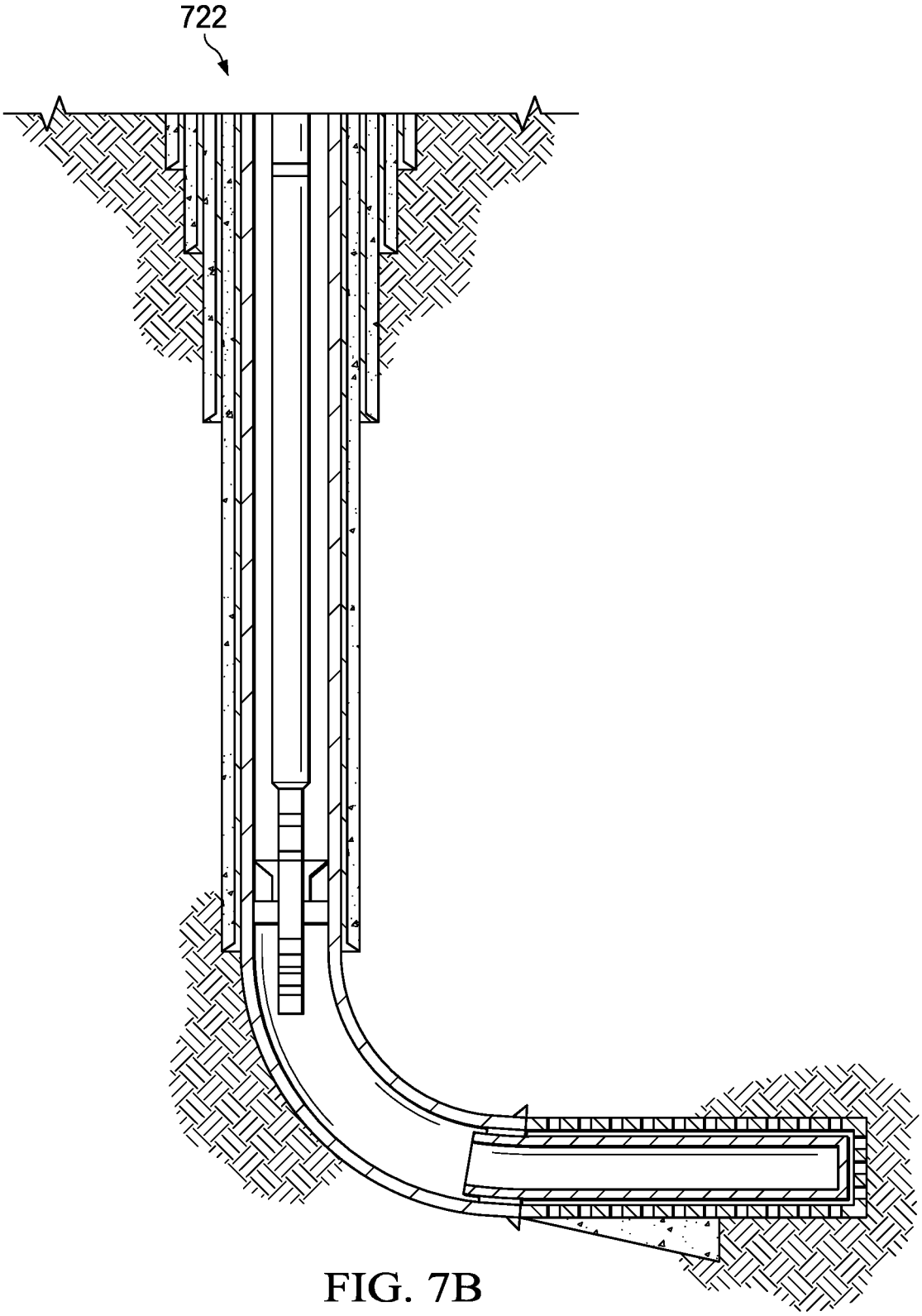
FIG. 7B is a diagram of an example of a well, according to some implementations of the present disclosure.

At 718, the wellhead is secured. At 720, the well is classified as a non-operable well, and the well becomes a candidate for a workover to change the completion string. Sketch 722 is a sketch of a Christmas tree and wellhead assembly for a natural flow well that corresponds to the steps of workflow 700. FIG. 7B is a diagram of an example of a well 722, according to some implementations of the present disclosure.

Figure 8A:
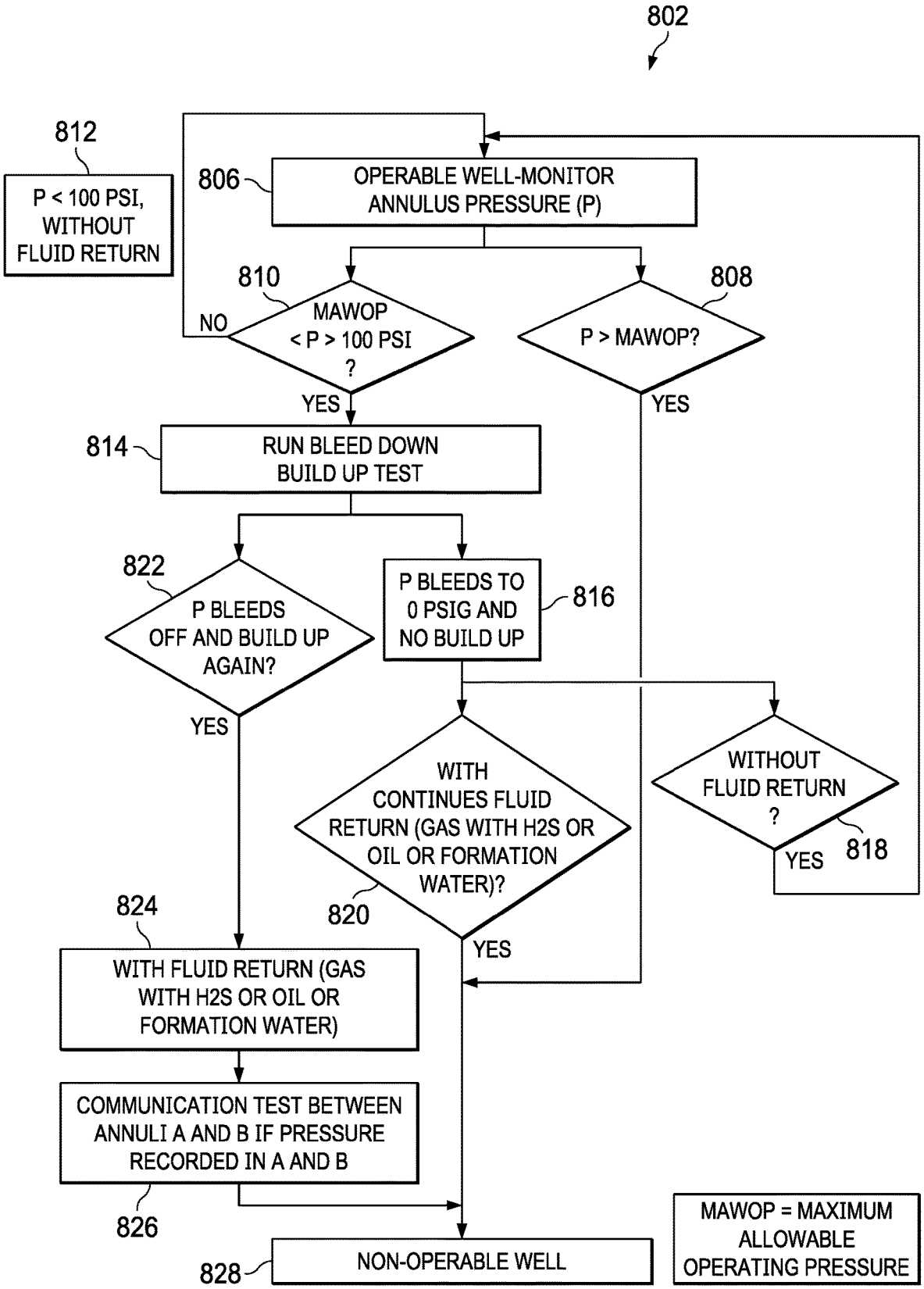
FIGS. 8A-8C collectively include a flowchart showing an example of a workflow for detailed well integrity management of ESP oil wells utilizing data integration between surface and downhole parameters for offshore/onshore oil field, according to some implementations of the present disclosure.
Figure 8B:
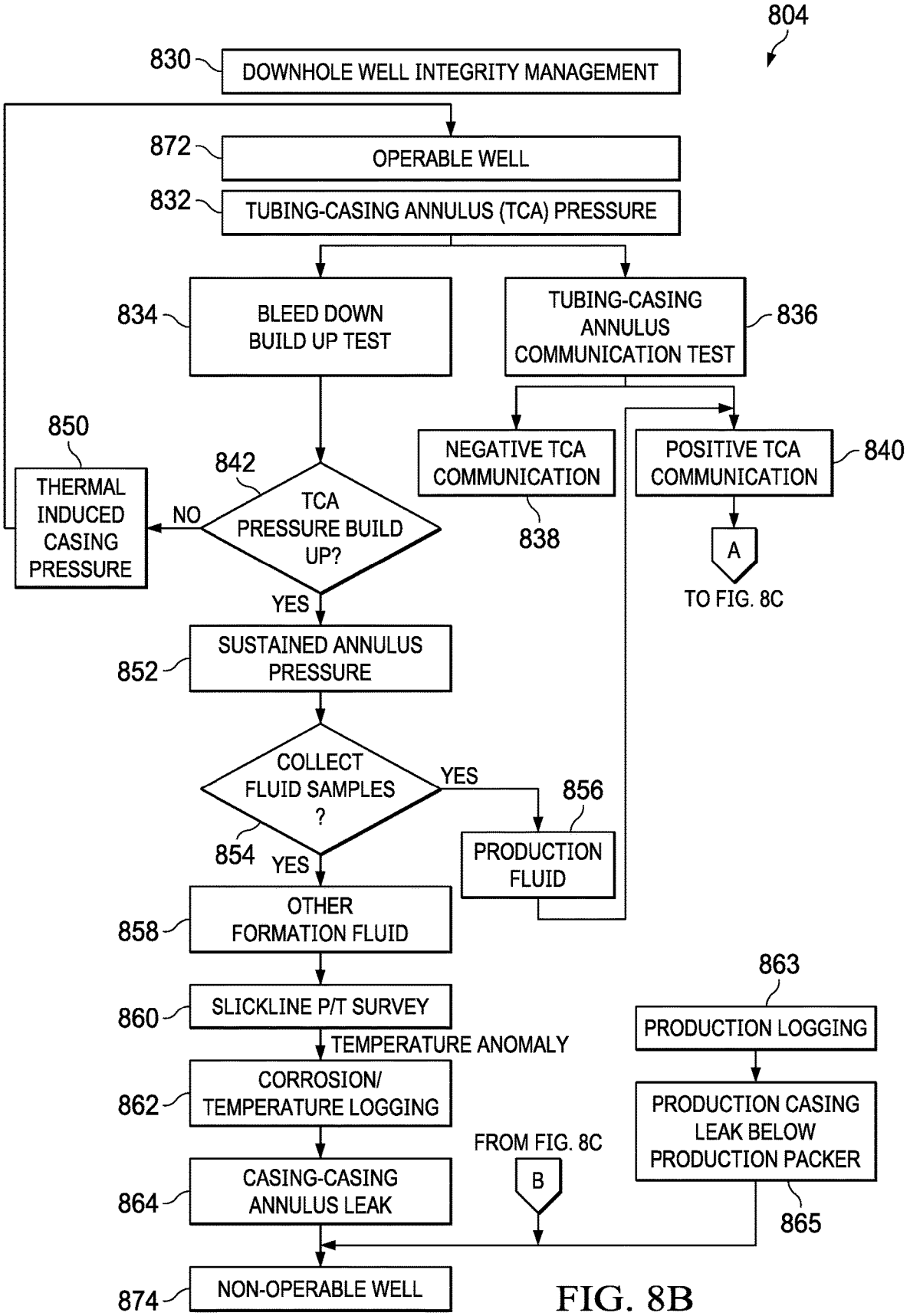
Figure 8C:
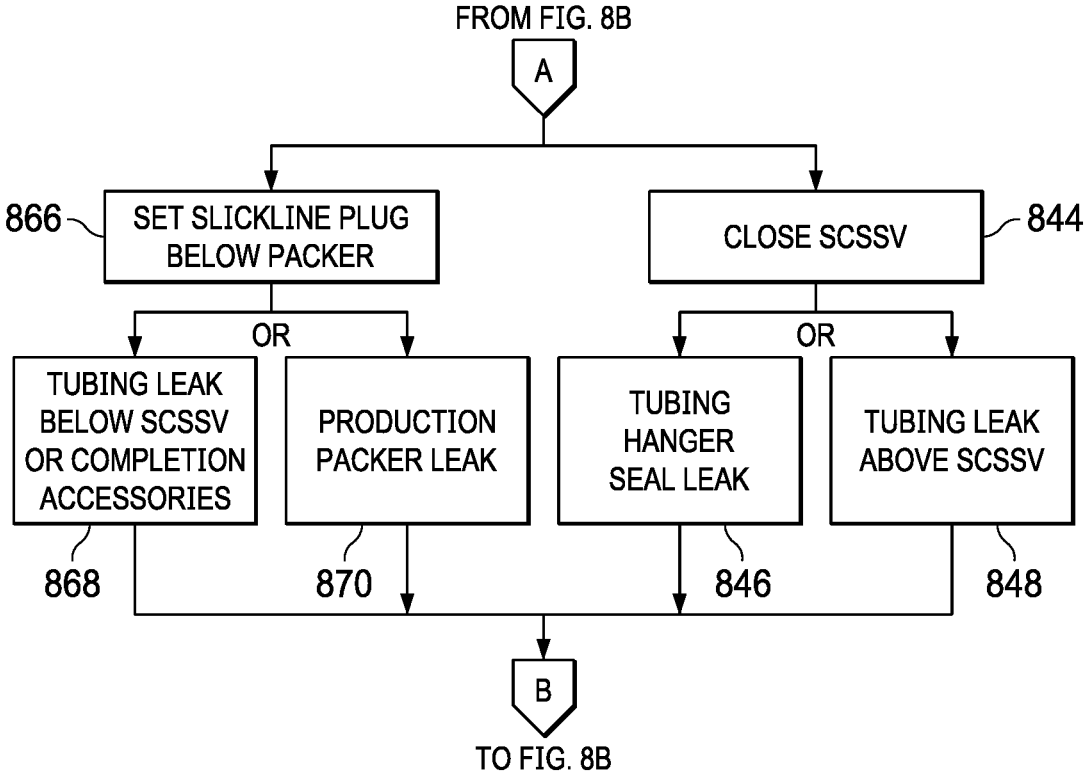

FIGS. 8A-8C collectively include a flowchart showing an example of a workflow 800 for detailed well integrity management of natural flow oil wells utilizing data integration between surface and downhole parameters for offshore/onshore oil field, according to some implementations of the present disclosure. The workflow 800 is spread over surface procedures 802 and downhole procedures 804. The workflow 800 includes a proper workover plan which includes the following steps on well selection related to SCP.

Referring to the surface procedures 802, at 806, steps are initiated for carrying out an annuli survey and well head maintenance campaign to monitor annulus pressures (P). At 808, if the annulus pressure is greater than the maximum allowable operating pressure (MAWOP) with a confirmed sustained pressure, then the well can be identified as an immediate candidate for a workover.

At 810, if the annulus pressure is more than 100 psi but less than the maximum allowable operating pressure (MAWOP) without fluid return, then close monitoring the annulus pressure continues. At 812, if there is a fluid return, it would be an initial indication of SCP. In this case, bleed-down and build-up tests should be conducted.

At 814, during bleed-down and build-up tests, the following scenarios can occur. At 816, if the casing pressure is bled down to 0 psi and no pressure build-up is observed without fluid return at 818, then the well will continue to be closely monitored for annuli survey. If the casing pressure is bled down to 0 psi and no pressure build-up is observed with continuous fluid return and with formation water or oil-bearing reservoirs and/or gas with $H_2S$ at 820, then the fluid samples should be collected for lab analysis in order to identify the fluid source, and the well is selected to be a workover candidate. At 822, if the casing pressure is bled down to 0 psi and the pressure build-up is observed with a continuous fluid return, then at 824, fluid samples are collected for lab analysis in order to identify the fluid source either as being either from formation water or oil bearing reservoirs, and the well is selected as a workover candidate. At 826, in case of several casing pressures presenting on subject wells, communication tests between annulus casings are performed to identify the source of casing pressures. At 828, the well is identified as non-operable.

Referring to the downhole procedures 804, steps of the procedure are associated with well selection related to tubing—casing annulus (TCA) pressure. At 830, downhole well integrity management 830 is initiated for an operable well 872.

At 832, an annuli survey and well head maintenance campaign is carried out to monitor tubing-casing annulus (TCA) pressures (P). If the TCA pressure is more than 100 psi but less than the maximum allowable operating pressure (MAWOP) without fluid return, then a close monitoring the annulus pressure continues. If there is a fluid return, providing an initial indication of SCP, then bleed-down and build-up tests are conducted at 834.

During bleed-down and build-up tests 834, the following scenarios can exist. If the TCA casing pressure is bled down to 0 psi and no pressure build-up 842 is observed without fluid return (indicating thermal induced casing pressure 850), then the well will continue to be closely monitored for annuli survey and considered as an operable well. If TCA pressure is bled down to 0 psi and the pressure build-up is observed with continued fluid return, then sustained annulus pressure 852 is maintained, and fluid samples are to be collected 854 for lab analysis in order to identify the fluid source as being from either oil bearing reservoirs 856 or other formation fluid 858. If the fluid sample indicates produced fluid return, then a tubing casing annulus communication test 836 should be conducted. During the tubing casing annulus communication test 836, the following scenarios can occur: 1) a negative TCA communication test result 838 (indicating no TCA communication), or 2) a positive TCA communication result 840 (indicating that TCA communication exists).

If a negative TCA communication test result 838 is obtained, then the well is considered to be an operable well and is kept under close monitoring program. If a positive TCA communication test result 840 is confirmed, the SCSSV can be closed at 844, and then the following scenarios can apply: 1) a tubing hanger seal leak at 846, or 2) a tubing leak above the SCSSV at 848. At 840, if a positive TCA communication test result identifies a slickline plug is set below the packer 866, then 1) a tubing leak 868 exists below SCSSV/completion accessories (e.g., stinger seal assemblies, sliding side door/sleeve (SSD) assemblies, landing nipples, flow couplings, pup joints, and crossovers), or 2) a production packer leak 870 exists. The bleed-down wellhead tubing shut in pressure (WHSIP) is set to 0 psi and TCA pressure is monitored. In the case that the wellhead tubing shut-in pressure (WHSIP) shows build-up again to the pressure value of TCA, the well will be considered as a non-operable well 874, then must be selected for a workover candidate. In case the wellhead tubing shut-in pressure (WHSIP) shows a build-up again to the pressure value of TCA, the subject natural flow well can confirm a tubing leak below the SCSSV. In this case, the well will be considered as a non-operable well 874 and can be selected as a workover candidate. If a positive TCA communication test result is obtained with an open SCSSV and a slickline plug is set in the landing nipple below the production packer and bleed-down wellhead, then the tubing shut-in pressure (WH-SIP) can be set to 0 psi, and the TCA pressure is monitored. If production logging 863 indicates that a production casing leak 865 exists below the production packer, then the well will be considered as a non-operable well 874 and can be selected as a workover candidate.

If a negative TCA communication test result is obtained and pressure/temperature survey 860 and corrosion logging 862 is confirmed, then the temperature anomaly is across shallow aquifer formations that include corrosion with some metal thickness eaten away. Fluid samples analysis can identify the fluid source as being from either formation water or oil-bearing reservoirs. In this case, the subject natural flow well can have a confirmed Casing-Casing Annulus Leak 864. Further, the well will be considered as being a non-operable well 874, and the well can be selected as a workover candidate.

Figure 8D:
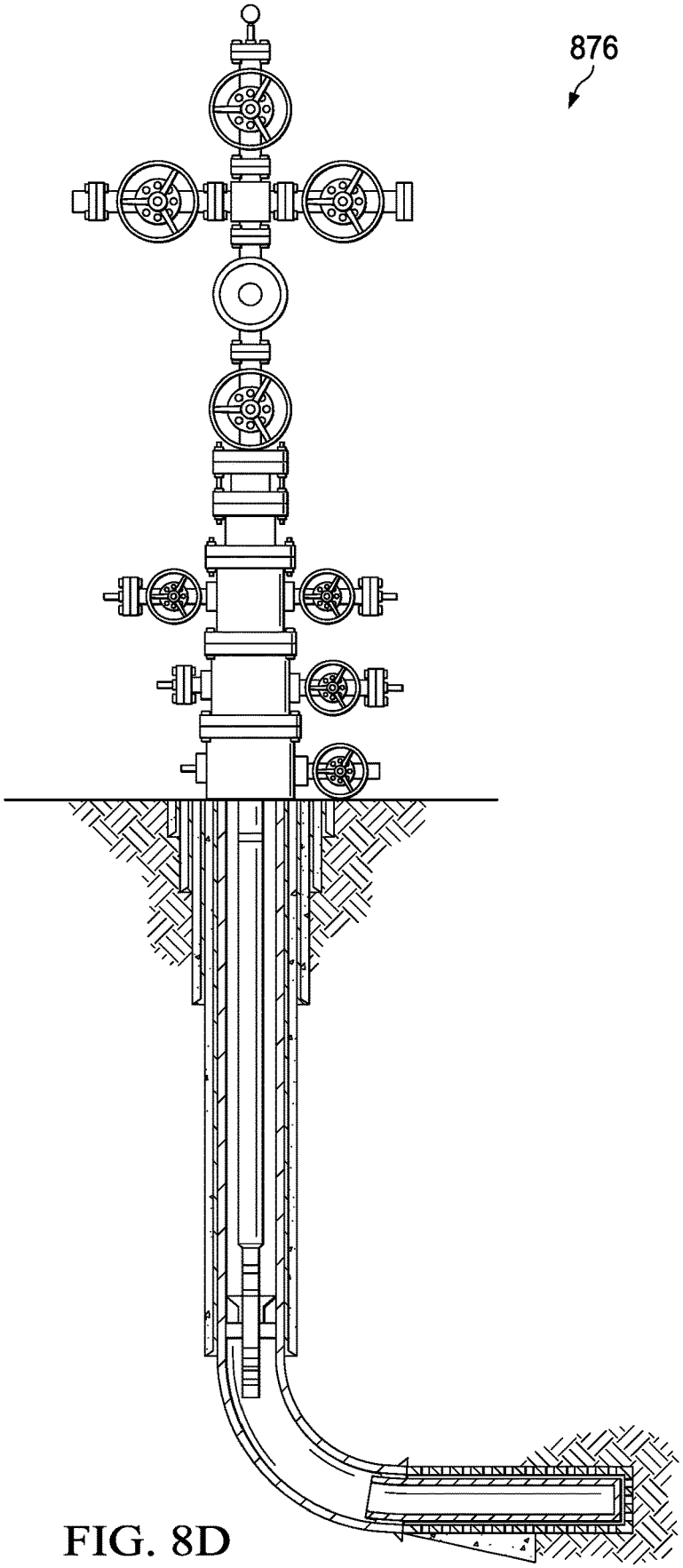
FIG. 8D is a diagram of an example of a well, according to some implementations of the present disclosure.

FIG. 8D is a diagram of an example of a well 876, according to some implementations of the present disclosure. Well 876 includes a Christmas tree and wellhead assembly for a natural flow well that corresponds to the steps of workflow 800.

Figure 9:
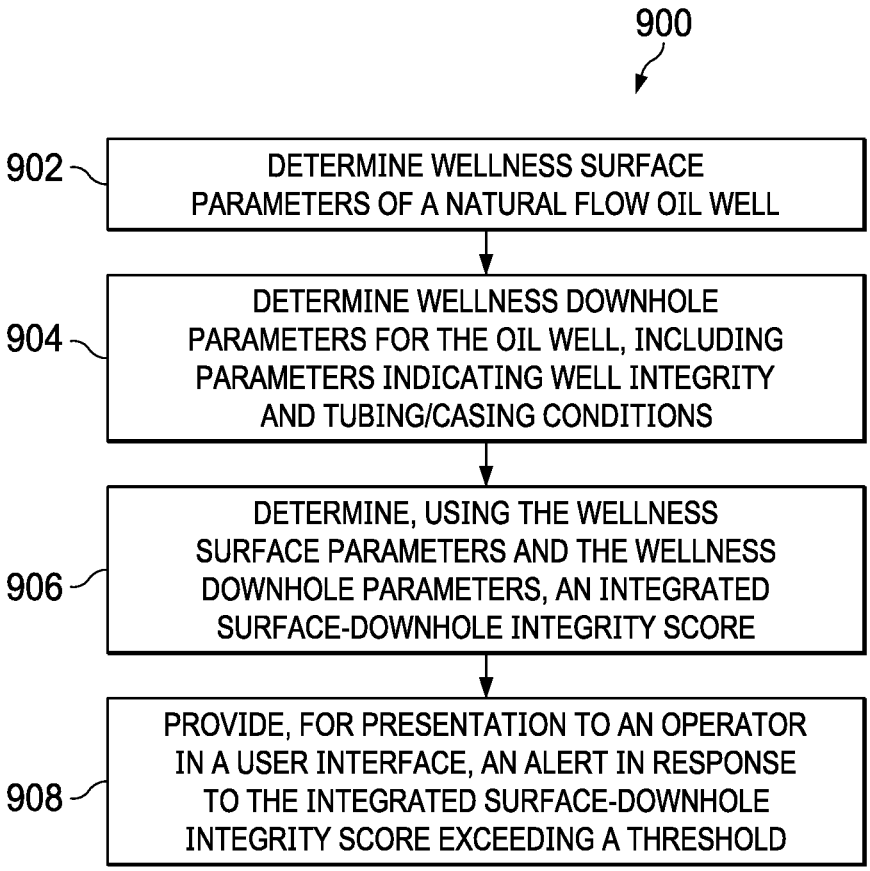
FIG. 9 is a flow chart showing an example workflow for determining an integrated surface-downhole integrity score for a natural flow oil well, according to some implementations of the present disclosure.

FIG. 9 is a flow chart showing an example workflow 900 for determining an integrated surface-downhole integrity score for Christmas tree and wellhead assembly valves of an ESP oil well, according to some implementations of the present disclosure. The workflow 900 can be implemented, for example, using steps of the workflow 800. For clarity of presentation, the description that follows generally describes method 900 in the context of the other figures in this description. However, it will be understood that method 900 can be performed, for example, by any suitable system, environment, software, and hardware, or a combination of systems, environments, software, and hardware, as appropriate. In some implementations, various steps of method 900 can be run in parallel, in combination, in loops, or in any order.

At 902, wellness surface parameters of a natural flow oil well are determined. The wellness surface parameters indicate, for example, that problems with sustained casing pressure (SCP) and tubing/casing leaks. The wellness surface parameters can include, for example, wellhead pressure and temperature; production rates of oil, gas, and water; and volts, amps, and frequency. From 902, method 900 proceeds to 904.

At 904, wellness downhole parameters for the natural flow oil well are determined, including parameters indicating well integrity and tubing/casing conditions. For example, if production logging 863 indicates that a production casing leak 865 exists below the production packer, then the well will be considered as a non-operable well 874 and can be selected as a workover candidate. The parameters can be determined by production logging From 904, method 900 proceeds to 906.

At 906, an integrated surface-downhole integrity score is determined using the wellness surface parameters and the wellness downhole parameters. The integrated surface-downhole integrity score indicates an integrated integrity of Christmas tree and wellhead assembly valves for the ESP oil well. From 906, method 900 proceeds to 908.

At 908, an alert is provided in response to determining that the integrated surface-downhole integrity score exceeds a threshold. The alert is provided for presentation to an operator in a user interface. As an example, the alert can include an indication that the oil well is non-operable and should be shut down. After 908, method 900 can stop.

In some implementations, method 900 further includes determining that an annulus pressure is greater than a maximum allowable operating pressure (MAWOP) confirmed as a sustained pressure, and that the ESP well is a candidate for an immediate workover. For example, step 808 and other steps of the workflow 800 for detailed well integrity management of ESP oil wells can be used for determining that the annulus pressure is greater than the MAWOP.

Figure 10:
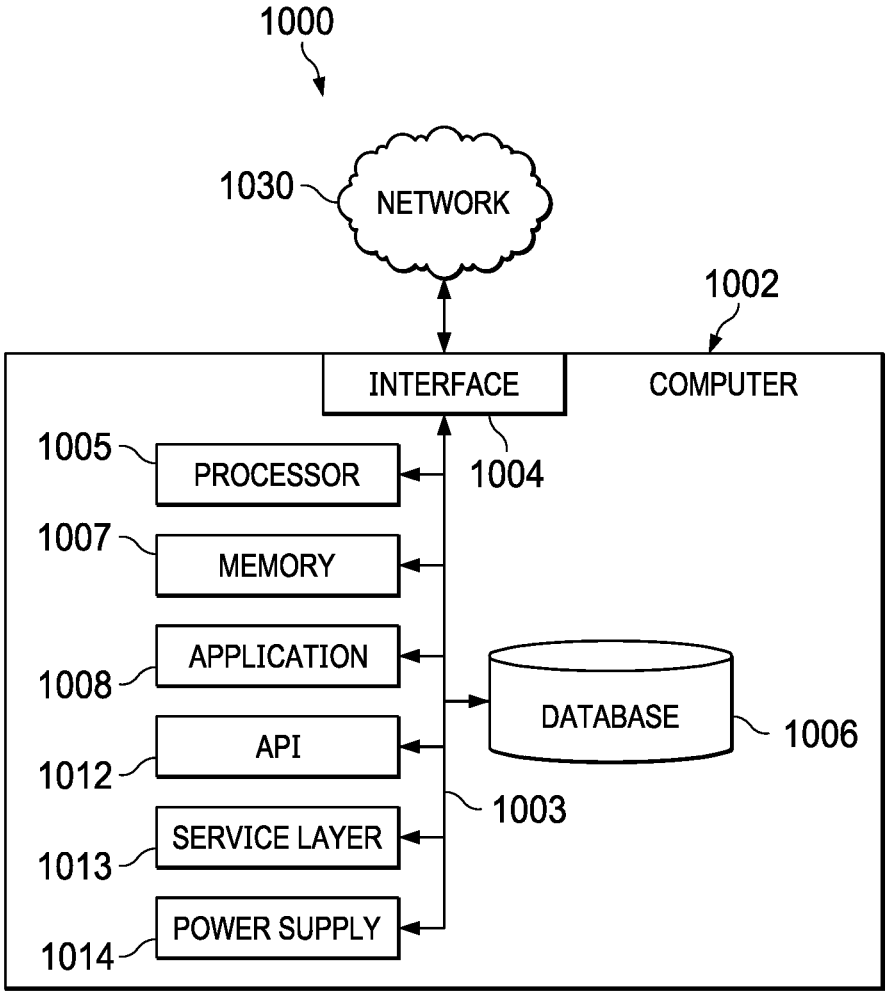
FIG. 10 is a block diagram illustrating an example computer system used to provide computational functionalities associated with described algorithms, methods, functions, processes, flows, and procedures as described in the present disclosure, according to some implementations of the present disclosure.

FIG. 10 is a block diagram of an example computer system 1000 used to provide computational functionalities associated with described algorithms, methods, functions, processes, flows, and procedures described in the present disclosure, according to some implementations of the present disclosure. The illustrated computer 1002 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 1002 can include input devices such as keypads, keyboards, and touch screens that can accept user information. Also, the computer 1002 can include output devices that can convey information associated with the operation of the computer 1002. The information can include digital data, visual data, audio information, or a combination of information. The information can be presented in a graphical user interface (UI) (or GUI).

The computer 1002 can serve in a role as a client, a network component, a server, a database, a persistency, or components of a computer system for performing the subject matter described in the present disclosure. The illustrated computer 1002 is communicably coupled with a network 1030. In some implementations, one or more components of the computer 1002 can be configured to operate within different environments, including cloud-computing-based environments, local environments, global environments, and combinations of environments.

At a top level, the computer 1002 is an electronic computing device operable to receive, transmit, process, store, and manage data and information associated with the described subject matter. According to some implementations, the computer 1002 can also include, or be communicably coupled with, an application server, an email server, a web server, a caching server, a streaming data server, or a combination of servers.

The computer 1002 can receive requests over network 1030 from a client application (for example, executing on another computer 1002). The computer 1002 can respond to the received requests by processing the received requests using software applications. Requests can also be sent to the computer 1002 from internal users (for example, from a command console), external (or third) parties, automated applications, entities, individuals, systems, and computers.

Each of the components of the computer 1002 can communicate using a system bus 1003. In some implementations, any or all of the components of the computer 1002, including hardware or software components, can interface with each other or the interface 1004 (or a combination of both) over the system bus 1003. Interfaces can use an application programming interface (API) 1012, a service layer 1013, or a combination of the API 1012 and service layer 1013. The API 1012 can include specifications for routines, data structures, and object classes. The API 1012 can be either computer-language independent or dependent. The API 1012 can refer to a complete interface, a single function, or a set of APIs.

The service layer 1013 can provide software services to the computer 1002 and other components (whether illustrated or not) that are communicably coupled to the computer 1002. The functionality of the computer 1002 can be accessible for all service consumers using this service layer. Software services, such as those provided by the service layer 1013, can provide reusable, defined functionalities through a defined interface. For example, the interface can be software written in JAVA, C++, or a language providing data in extensible markup language (XML) format. While illustrated as an integrated component of the computer 1002, in alternative implementations, the API 1012 or the service layer 1013 can be stand-alone components in relation to other components of the computer 1002 and other components communicably coupled to the computer 1002. Moreover, any or all parts of the API 1012 or the service layer 1013 can be implemented as child or sub-modules of another software module, enterprise application, or hardware module without departing from the scope of the present disclosure.

The computer 1002 includes an interface 1004. Although illustrated as a single interface 1004 in FIG. 10, two or more interfaces 1004 can be used according to particular needs, desires, or particular implementations of the computer 1002 and the described functionality. The interface 1004 can be used by the computer 1002 for communicating with other systems that are connected to the network 1030 (whether illustrated or not) in a distributed environment. Generally, the interface 1004 can include, or be implemented using, logic encoded in software or hardware (or a combination of software and hardware) operable to communicate with the network 1030. More specifically, the interface 1004 can include software supporting one or more communication protocols associated with communications. As such, the network 1030 or the interface's hardware can be operable to communicate physical signals within and outside of the illustrated computer 1002.

The computer 1002 includes a processor 1005. Although illustrated as a single processor 1005 in FIG. 10, two or more processors 1005 can be used according to particular needs, desires, or particular implementations of the computer 1002 and the described functionality. Generally, the processor 1005 can execute instructions and can manipulate data to perform the operations of the computer 1002, including operations using algorithms, methods, functions, processes, flows, and procedures as described in the present disclosure.

The computer 1002 also includes a database 1006 that can hold data for the computer 1002 and other components connected to the network 1030 (whether illustrated or not). For example, database 1006 can be an in-memory, conventional, or a database storing data consistent with the present disclosure. In some implementations, database 1006 can be a combination of two or more different database types (for example, hybrid in-memory and conventional databases) according to particular needs, desires, or particular implementations of the computer 1002 and the described functionality. Although illustrated as a single database 1006 in FIG. 10, two or more databases (of the same, different, or combination of types) can be used according to particular needs, desires, or particular implementations of the computer 1002 and the described functionality. While database 1006 is illustrated as an internal component of the computer 1002, in alternative implementations, database 1006 can be external to the computer 1002.

The computer 1002 also includes a memory 1007 that can hold data for the computer 1002 or a combination of components connected to the network 1030 (whether illustrated or not). Memory 1007 can store any data consistent with the present disclosure. In some implementations, memory 1007 can be a combination of two or more different types of memory (for example, a combination of semiconductor and magnetic storage) according to particular needs, desires, or particular implementations of the computer 1002 and the described functionality. Although illustrated as a single memory 1007 in FIG. 10, two or more memories 1007 (of the same, different, or combination of types) can be used according to particular needs, desires, or particular implementations of the computer 1002 and the described functionality. While memory 1007 is illustrated as an internal component of the computer 1002, in alternative implementations, memory 1007 can be external to the computer 1002.

The application 1008 can be an algorithmic software engine providing functionality according to particular needs, desires, or particular implementations of the computer 1002 and the described functionality. For example, application 1008 can serve as one or more components, modules, or applications. Further, although illustrated as a single application 1008, the application 1008 can be implemented as multiple applications 1008 on the computer 1002. In addition, although illustrated as internal to the computer 1002, in alternative implementations, the application 1008 can be external to the computer 1002.

The computer 1002 can also include a power supply 1014. The power supply 1014 can include a rechargeable or non-rechargeable battery that can be configured to be either user- or non-user-replaceable. In some implementations, the power supply 1014 can include power-conversion and management circuits, including recharging, standby, and power management functionalities. In some implementations, the power-supply 1014 can include a power plug to allow the computer 1002 to be plugged into a wall socket or a power source to, for example, power the computer 1002 or recharge a rechargeable battery.

There can be any number of computers 1002 associated with, or external to, a computer system containing computer 1002, with each computer 1002 communicating over network 1030. Further, the terms "client," "user," and other appropriate terminology can be used interchangeably, as appropriate, without departing from the scope of the present disclosure. Moreover, the present disclosure contemplates that many users can use one computer 1002 and one user can use multiple computers 1002.

Described implementations of the subject matter can include one or more features, alone or in combination.

For example, in a first implementation, a computer-implemented method includes the following. Wellness surface parameters of a natural flow oil well are determined. Wellness downhole parameters for the natural flow oil well are determined, including parameters indicating well integrity and tubing/casing conditions. An integrated surface-downhole integrity score is determined using the wellness surface parameters and the wellness downhole parameters. An alert is provided for presentation to an operator in a user interface. The alert is provided in response to the integrated surface-downhole integrity score exceeding a threshold.

The foregoing and other described implementations can each, optionally, include one or more of the following features:

A first feature, combinable with any of the following features, where the wellness surface parameters include wellhead pressure and temperature; production rates of oil, gas, and water; and volts, amps, and frequency.

A second feature, combinable with any of the previous or following features, the method further including: performing production logging on the natural flow oil well, including monitoring a production packer of the well; determining, based on the production logging, that a cross flow exists; and determining, in response to determining that the cross flow exists, that a production casing leak exists below the production packer.

A third feature, combinable with any of the previous or following features, where the wellness surface parameters of the ESP oil well include parameters for Christmas tree and wellhead assembly valves for the oil well.

A fourth feature, combinable with any of the previous or following features, where the alert includes an indication that the oil well is non-operable and should be shut down.

A fifth feature, combinable with any of the previous or following features, the method further including determining that an annulus pressure is greater than a maximum allowable operating pressure (MAWOP) confirmed as a sustained pressure, and that the ESP well is a candidate for an immediate workover.

A sixth feature, combinable with any of the previous or following features, where the wellness surface parameters indicate problems with sustained casing pressure (SCP) and tubing/casing leaks.

In a second implementation, a non-transitory, computer-readable medium stores one or more instructions executable by a computer system to perform operations including the following. Wellness surface parameters of a natural flow oil well are determined. Wellness downhole parameters for the natural flow oil well are determined, including parameters indicating well integrity and tubing/casing conditions. An integrated surface-downhole integrity score is determined using the wellness surface parameters and the wellness downhole parameters. An alert is provided for presentation to an operator in a user interface. The alert is provided in response to the integrated surface-downhole integrity score exceeding a threshold.

The foregoing and other described implementations can each, optionally, include one or more of the following features:

A first feature, combinable with any of the following features, where the wellness surface parameters include wellhead pressure and temperature; production rates of oil, gas, and water; and volts, amps, and frequency.

A second feature, combinable with any of the previous or following features, the operations further including: performing production logging on the natural flow oil well, including monitoring a production packer of the well; determining, based on the production logging, that a cross flow exists; and determining, in response to determining that the cross flow exists, that a production casing leak exists below the production packer.

A third feature, combinable with any of the previous or following features, where the wellness surface parameters of the ESP oil well include parameters for Christmas tree and wellhead assembly valves for the oil well.

A fourth feature, combinable with any of the previous or following features, where the alert includes an indication that the oil well is non-operable and should be shut down.

A fifth feature, combinable with any of the previous or following features, the operations further including determining that an annulus pressure is greater than a maximum allowable operating pressure (MAWOP) confirmed as a sustained pressure, and that the ESP well is a candidate for an immediate workover.

A sixth feature, combinable with any of the previous or following features, where the wellness surface parameters indicate problems with sustained casing pressure (SCP) and tubing/casing leaks.

In a third implementation, a computer-implemented system includes one or more processors and a non-transitory computer-readable storage medium coupled to the one or more processors and storing programming instructions for execution by the one or more processors. The programming instructions instruct the one or more processors to perform operations including the following. Wellness surface parameters of a natural flow oil well are determined. Wellness downhole parameters for the natural flow oil well are determined, including parameters indicating well integrity and tubing/casing conditions. An integrated surface-downhole integrity score is determined using the wellness surface parameters and the wellness downhole parameters. An alert is provided for presentation to an operator in a user interface. The alert is provided in response to the integrated surface-downhole integrity score exceeding a threshold.

The foregoing and other described implementations can each, optionally, include one or more of the following features:

A first feature, combinable with any of the following features, where the wellness surface parameters include wellhead pressure and temperature; production rates of oil, gas, and water; and volts, amps, and frequency.

A second feature, combinable with any of the previous or following features, the operations further including: performing production logging on the natural flow oil well, including monitoring a production packer of the well; determining, based on the production logging, that a cross flow exists; and determining, in response to determining that the cross flow exists, that a production casing leak exists below the production packer.

A third feature, combinable with any of the previous or following features, where the wellness surface parameters of the ESP oil well include parameters for Christmas tree and wellhead assembly valves for the oil well.

A fourth feature, combinable with any of the previous or following features, where the alert includes an indication that the oil well is non-operable and should be shut down.

A fifth feature, combinable with any of the previous or following features, the operations further including determining that an annulus pressure is greater than a maximum allowable operating pressure (MAWOP) confirmed as a sustained pressure, and that the ESP well is a candidate for an immediate workover.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback.

Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented method, comprising:

determining, from first data received from one or more surface pressure sensors, values of wellness surface parameters of a natural flow oil well indicating a casing pressure over a period of time near at least one surface valve of the oil well;

determining, from second data received one or more downhole sensors, values of wellness downhole parameters for the natural flow oil well, including parameters indicating a presence or absence of leaks and a condition of cementing in well casing;

determining, using the values of the wellness surface parameters and the values of the wellness downhole parameters, an integrated surface-downhole integrity score;

providing, for presentation to an operator in a user interface, an alert in response to the integrated surface-downhole integrity score exceeding a threshold, the alert indicating that the oil well is operable or non-operable;

in response to the alert indicating that the oil well is operable, generating a first instruction causing operation of the oil well to continue or to resume; and in response to the alert indicating that the oil well is non-operable, generating a second instruction causing operation of the oil well to shut down.

2. The computer-implemented method of claim 1, wherein the wellness surface parameters include wellhead pressure and temperature; production rates of oil, gas, and water;

and volts, amps, and frequency.

3. The computer-implemented method of claim 1, further comprising:

performing production logging on the natural flow oil well, including monitoring a production packer of the well;

determining, based on the production logging, that a cross flow exists; and determining, in response to determining that the cross flow exists, that a production casing leak exists below the production packer.

4. The computer-implemented method of claim 1, wherein the wellness surface parameters of the oil well include parameters for Christmas tree and wellhead assembly valves for the oil well.

5. The computer-implemented method of claim 1, further comprising determining that an annulus pressure is greater than a maximum allowable operating pressure (MAWOP) confirmed as a sustained pressure, and that the oil well is a candidate for an immediate workover.

6. The computer-implemented method of claim 1, wherein the wellness surface parameters indicate problems with sustained casing pressure (SCP) and tubing/casing leaks.

7. A non-transitory, computer-readable medium storing one or more instructions executable by a computer system to perform operations comprising:

determining, from first data received from one or more surface pressure sensors, values of wellness surface parameters of a natural flow oil well indicating a casing pressure over a period of time near at least one surface valve of the oil well;

determining, from second data received from one or more downhole sensors, values of wellness downhole parameters for the natural flow oil well, including parameters indicating a presence or absence of leaks and a condition of cementing in well casing;

determining, using the wellness surface parameters and the wellness downhole parameters, an integrated surface-downhole integrity score; and providing, for presentation to an operator in a user interface, an alert in response to the integrated surface-downhole integrity score exceeding a threshold, the alert indicating that the oil well is operable or non-operable;

in response to the alert indicating that the oil well is operable, generating a first instruction causing operation of the oil well to continue or to resume; and in response to the alert indicating that the oil well is non-operable, generating a second instruction causing operation of the oil well to shut down.

8. The non-transitory, computer-readable medium of claim 7, wherein the wellness surface parameters include wellhead pressure and temperature; production rates of oil, gas, and water; and volts, amps, and frequency.

9. The non-transitory, computer-readable medium of claim 7, the operations further comprising:

performing production logging on the natural flow oil well, including monitoring a production packer of the well;

determining, based on the production logging, that a cross flow exists; and determining, in response to determining that the cross flow exists, that a production casing leak exists below the production packer.

10. The non-transitory, computer-readable medium of claim 7, wherein the wellness surface parameters of the oil well include parameters for Christmas tree and wellhead assembly valves for the oil well.

11. The non-transitory, computer-readable medium of claim 7, the operations further comprising determining that an annulus pressure is greater than a maximum allowable operating pressure (MAWOP) confirmed as a sustained pressure, and that the oil well is a candidate for an immediate workover.

12. The non-transitory, computer-readable medium of claim 7, wherein the wellness surface parameters indicate problems with sustained casing pressure (SCP) and tubing/casing leaks.

13. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

determining, from first data received from one or more surface pressure sensors, values of wellness surface parameters of a natural flow oil well indicating a casing pressure over a period of time near at least one surface valve of the oil well;

determining, from second data received from one or more downhole sensors, values of wellness downhole parameters for the natural flow oil well, including parameters indicating a presence or absence of leaks and a condition of cementing in well casing;

determining, using the wellness surface parameters and the wellness downhole parameters, an integrated surface-downhole integrity score; and providing, for presentation to an operator in a user interface, an alert in response to the integrated surface-downhole integrity score exceeding a threshold, the alert indicating that the oil well is operable or non-operable;

in response to the alert indicating that the oil well is operable, generating a first instruction causing operation of the oil well to continue or to resume; and in response to the alert indicating that the oil well is non-operable, generating a second instruction causing operation of the oil well to shut down.

14. The computer-implemented system of claim 13, wherein the wellness surface parameters include wellhead pressure and temperature; production rates of oil, gas, and water; and volts, amps, and frequency.

15. The computer-implemented system of claim 13, the operations further comprising:

performing production logging on the natural flow oil well, including monitoring a production packer of the well;

determining, based on the production logging, that a cross flow exists; and determining, in response to determining that the cross flow exists, that a production casing leak exists below the production packer.

16. The computer-implemented system of claim 13, wherein the wellness surface parameters of the oil well include parameters for Christmas tree and wellhead assembly valves for the oil well.

17. The computer-implemented system of claim 13, the operations further comprising determining that an annulus pressure is greater than a maximum allowable operating pressure (MAWOP) confirmed as a sustained pressure, and that the oil well is a candidate for an immediate workover.

* * * * *